United States Patent [19]

Smith

[11] 4,202,138

[45] May 13, 1980

[54] BEZEL GRINDING ATTACHMENT FOR A DOP STICK HOLDER

[75] Inventor: Edward E. Smith, New London, Iowa

[73] Assignee: Geode Industries, Inc., New London, Iowa

[21] Appl. No.: 48,476

[22] Filed: Jun. 14, 1979

[51] Int. Cl.[2] ..... B24B 11/00

[52] U.S. Cl. ..... 51/229; 51/239

[58] Field of Search ..... 51/229, 216 R, 239

[56] References Cited

U.S. PATENT DOCUMENTS

| | | | |
|---|---|---|---|
| 102,420 | 4/1870 | Mossteller | 51/239 |
| 1,395,664 | 11/1921 | Benson | 51/239 |
| 4,010,575 | 3/1977 | Henry | 51/229 |

FOREIGN PATENT DOCUMENTS

| | | | |
|---|---|---|---|
| 175059 | 2/1922 | United Kingdom | 51/238 |

*Primary Examiner*—Harold D. Whitehead

*Attorney, Agent, or Firm*—Haven E. Simmons; James C. Nemmers

[57] ABSTRACT

A removable bezel grinding attachment for a dop stick holder features a bezel table for support of a cabochon, the table replacing the dop stick of the holder, and means for adjusting the inclination of the table.

3 Claims, 2 Drawing Figures

BEZEL GRINDING ATTACHMENT FOR A DOP STICK HOLDER

BACKGROUND OF THE INVENTION

Before grinding of its face, the edge of a cabochon is usually first ground to the correct bezel configuration and angle on a bezel table attached to a grinder. The table is then removed from the grinder and the cabochon mounted on a dop stick so that its face can be ground to the proper curvature. Preferably, the dop stick is mounted in a holder such as that of U.S. Pat. No. 4,010,575 which greatly increases the ease and accuracy of grinding the cabochon's face. All this, however, involves extra time and trouble, namely, shifting back and forth between the bezel table on the one hand and the dop stick holder on the other, and this it is the object of the present invention to avoid.

SUMMARY OF THE INVENTION

The invention provides a modification or attachment for a dop stick holder of the nature of that in the foregoing patent wherein the dop stick of the holder is removed and replaced with a flat plate which serves as a bezel table. Additional fittings adjustably fix the inclination of the plate relative to the grinder so that the desired bezel configuration and angle of a cabochon can be ground. Thus the need to remove the entire holder, which is normally bolted or clamped to the grinder or to the stand upon which the grinder is mounted, in order to use a bezel table, and vice versa, is obviated.

DETAILED DESCRIPTION OF THE PREFERRED EMBODIMENT

Figure 1:
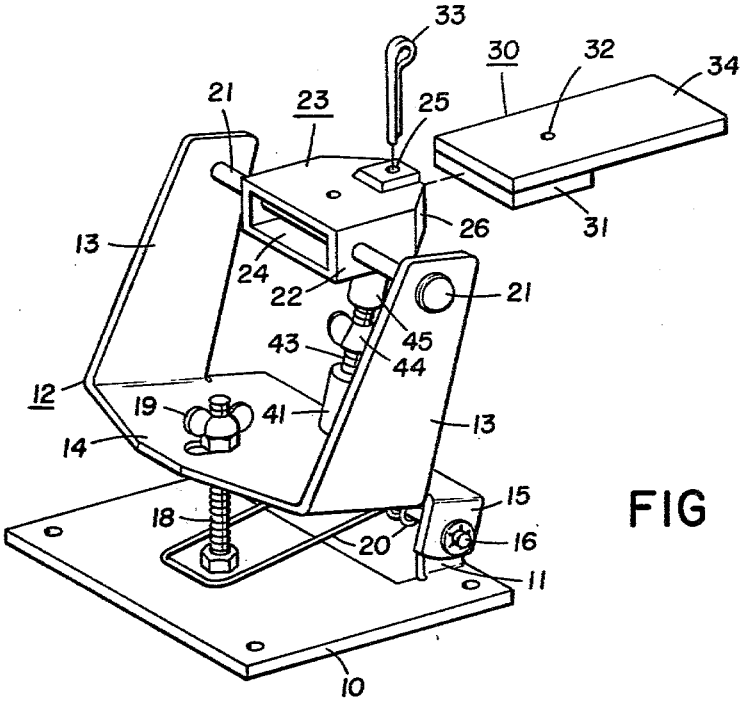
FIG. 1 is an isometric, elevational view, in partly exploded form, of a dop stick holder according to the foregoing patent equipped with the bezel table attachment of the present invention.

Referring to the drawings in conjunction with the foregoing patent, whose description is incorporated herein, the dop stick holder comprises a rectangular base plate 10 formed with a pair of upset ears 11 (only one being shown) adjacent the ends of its front edge. A U-shaped bracket 12 having upright arms 13 and a connecting floor 14 is pivotally supported on the base plate 10 by means of a pair of ears 15 (only one being shown) downset from the ends of the front edge of the floor 14 and hinged to the ears 11 by a transverse hinge rod 16. The position of the support bracket 12 relative to the base plate 10 is adjustably maintained by a threaded post 18 from the plate 10 which passes up through a fore-and-aft slotted aperture in the bracket floor 14 and is surmounted by a wing nut 19. A shaped hair spring 20 of the torsion bar type is anchored about the hinge rod 16 with its legs bearing against the opposed faces of the base plate 10 and the bracket floor 14, all for the purposes described in the foregoing patent. Spanning the upper ends of the bracket arms 13 and mounted therein, a second hinge rod 21 extends through the rear portion 22 of a relatively wide but squat dop stick receiver 23. The latter is hollowed to provide an opening 24 therethrough from front to rear, the opening 24 being rectangular in cross-sectional configuration. The receiver 23 is free to pivot, as well as to slide laterally both ways on the hinge rod 21, and normally carries within it a dop stick pivoted on a removable pin passing down through a bore 25 in the forward portion 26 of the receiver 23.

Figure 2:
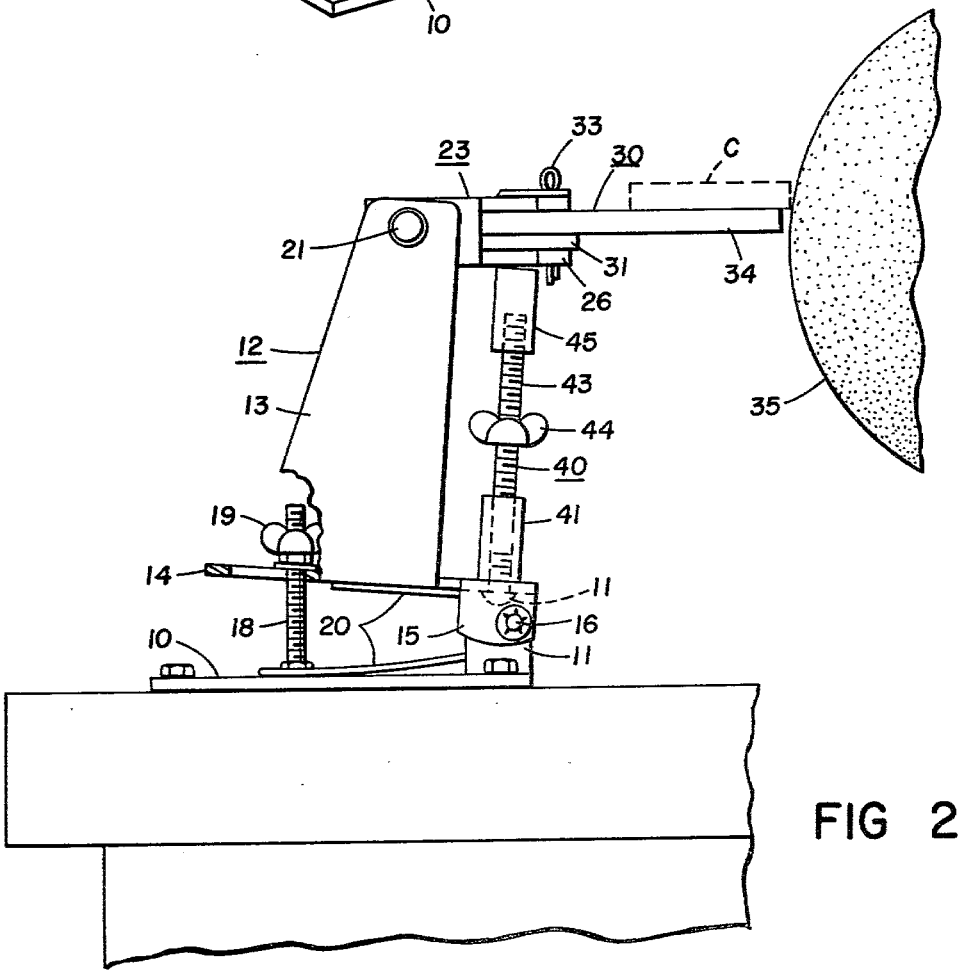
FIG. 2 is a side elevational view of the holder of FIG. 1 mounted before a grinding wheel with the bezel table attachment in position for grinding of the bezel configuration and angle of a cabochon.

In the present invention the dop stick and pin in the foregoing patent are removed and replaced with a bezel table 30 in the form of a flat rectangular plate having a thickened rear portion or heel 31 also having a rectangular cross-sectional configuration so as to fit snugly within the receiver opening 24, the four longitudinal faces of the heel 31 slidingly engaging the four corresponding interior faces of the receiver opening 24. The heel 31 is bored at 32 to align with the receiver bore 25 and to receive a cotter pin 23 in order to retain the table 30. The forward portion or toe 34 of the table 30 extends in turn forwardly adjacent the grinding wheel 35, as shown in FIG. 2. The desired inclination of the table 30 is achieved by a strut assembly 40 consisting of a lower post 41 disposed on the bracket floor 14 above the hinge rod 16 midway between the arms 13. The post 41 is internally threaded throughout its length and secured by a screw 42 passing up through the floor 14 and into the post 41. The latter, once affixed, can remain on the dop stick holder whether it is being used with the table 30 or normally with a dop stick. Into the upper end of the post 41 is threaded the lower end of a support rod 43, carrying a wing nut 44 midway therealong and surmounted by an upper post or cap 45 permanently threaded thereon which engages the underside of the forward receiver portion 26. By turning the rod 43 in or out of the post 14 the inclination of the bezel table 30 can be adjusted and secured by turning the wing nut 44 down onto the post 14. The table 30 is then ready to support a cabochon C for grinding of its bezel configuration and angle, as indicated in FIG. 2. The attachment can be removed simply by withdrawing the cotter pin 33 and the table 30 and then unscrewing the rod 34 from the post 41, whence a dop stick can be replaced in the receiver 23, and vice versa.

Though the present invention has been described in terms of a particular embodiment, being the best most known of carrying out the invention, it is not limited to that embodiment alone. Instead, the following claims are to be read as encompassing all adaptations and modifications of the invention falling within its spirit and scope.

I claim:

1. A cabochon bezel grinding attachment for use with a dop stick holder which includes a laterally extensive dop stick receiver and a carrying structure for the receiver having an underportion spaced below the receiver, the receiver having a rear portion hinged to the carrying structure about a horizontal axis, a forward portion, and a laterally extensive opening extending through the receiver in a direction from said forward to said rear portion thereof, said opening having a cross-sectional configuration defined by interior walls extending in said direction, and a transverse vertical bore through said forward receiver portion and intersecting said opening thereof, the attachment comprising: a laterally extensive bezel table having rear and forward portions, the table rear portion having a cross-sectional configuration complementary with that of the receiver opening and being slidably and fittably receivable therein, the table rear portion being further provided with a transverse vertical bore therethrough alignable with said receiver bore; fastening means for insertion through the receiver and table bores for removably securing the table in the receiver opening; and adjustable means for disposal between said forward portion of one of the receiver and the table on the one hand and said underportion of the carrying structure on the other hand effective both to support the bezel table forward portion upon said underportion and to adjust the inclination of the bezel table relative thereto about said axis.

2. The attachment of claim 1 wherein the bezel table rear portion is thicker in its vertical dimension than is said forward portion thereof.

3. The attachment of claim 1 or 2 wherein said adjusting means comprises a post fixable at one end to said underportion of the receiver carrying structure, a rod adjustably threadable at one end into the other end of said post, a cap fixed to the other end of the rod and engageable as aforesaid with one of said forward portions, and locking means threaded on the rod between the post and the cap and engageable with said other end of the post.

* * * * *